United States Patent [19]
Arimura et al.
[11] 3,934,438
[45] Jan. 27, 1976

[54] METHOD OF LONG-EDGE SHAPE CONTROL FOR TANDEM ROLLING MILL

[75] Inventors: Tohru Arimura, Yokohama; Masaru Okado, Tokyo; Takarokuro Ichimaru; Masamoto Kamata, both of Fukuyama, all of Japan

[73] Assignee: Nippon Kokan Kabushiki Kaisha, Tokyo, Japan

[22] Filed: Jan. 9, 1975

[21] Appl. No.: 539,787

Related U.S. Application Data

[63] Continuation of Ser. No. 409,684, Oct. 25, 1973, abandoned.

[30] Foreign Application Priority Data

May 9, 1973 Japan ..... 48-51465

[52] U.S. Cl. ..... 72/9; 72/12
[51] Int. Cl.[2] ..... B21B 37/00
[58] Field of Search ..... 72/8–16, 234

[56] References Cited

UNITED STATES PATENTS 3,599,459 8/1971 Yeomans ..... 72/8

OTHER PUBLICATIONS

"Backup Roll Bending," Dr. Stone, Iron & Steel Engr., Dec., 1969, pp. 69–87.

*Primary Examiner*—Milton S. Mehr
*Attorney, Agent, or Firm*—Flynn & Frishauf

[57] ABSTRACT

A method of shape control for a tandem mill for rolling strip, wherein the shape of the rolled strip at the delivery side of the final stand is detected to provide a signal corresponding to the long-edge shape, whereby the pattern of roll bending force for two or more latter stands are adjusted according to the signal or signals obtained in order to effect desired shape control without causing variations in the thickness of the strip at the delivery side of the last stand.

8 Claims, 10 Drawing Figures

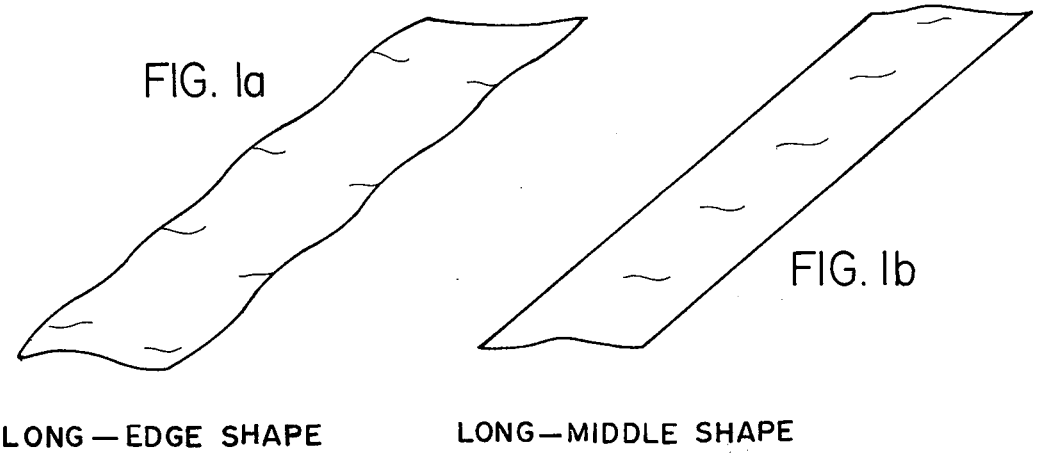
FIG. 2
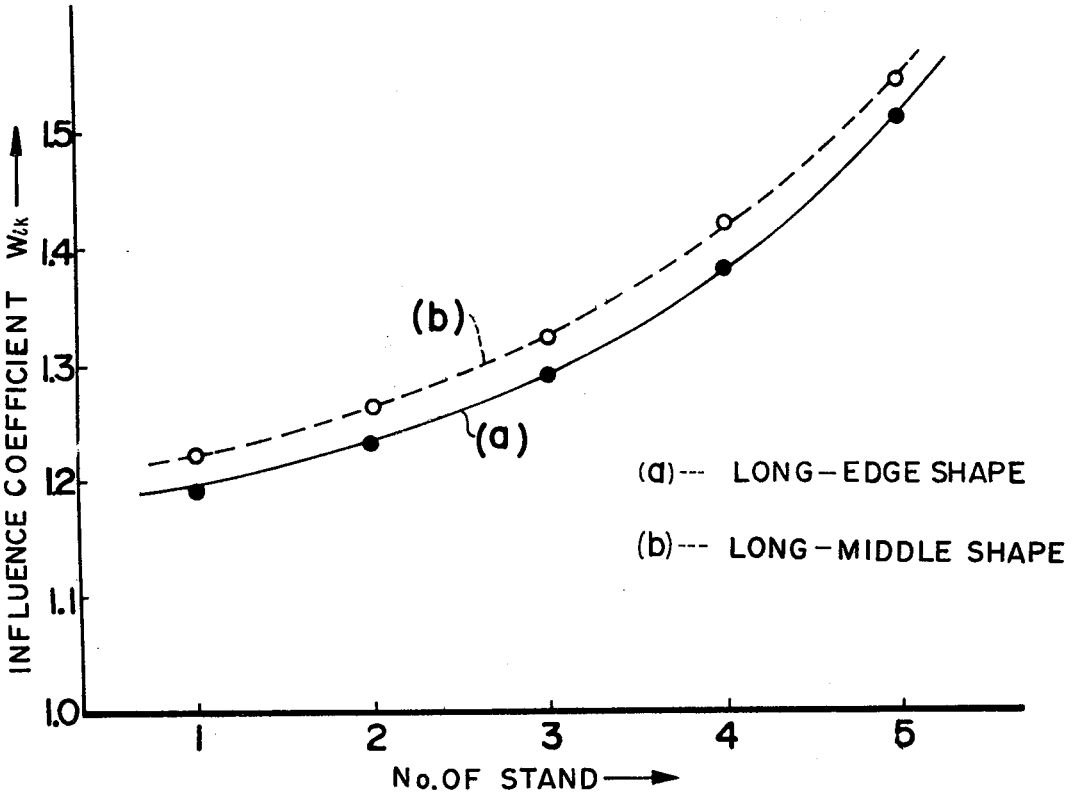

METHOD OF LONG-EDGE SHAPE CONTROL FOR TANDEM ROLLING MILL

This is a continuation, of application Ser. No. 409,684, filed Oct. 25, 1973, now abandoned.

BACKGROUND OF THE INVENTION

The present invention relates to a method of shape control for a hot or cold tandem mill for rolling strips.

Methods of shape control for controlling the shape of product, particularly control of long-edge shape or long-middle shape (these shapes are shown in FIG. 1, the former by (*a*) and the latter by (*b*)) of the product of a strip mill, are known in the art, in which the rolls of a single stand in the mill are forcibly deformed externally by means of a roll bender or alternately the corrections of product shape are effected through control of tension by tension control means.

For example, the use of tension control means for this purpose is well known from pages 1214 to 1222 of "Stahl und Eisen" No. 90, Vol. 22. However, the application of control by such known shape control means is invariably confined to a single stand, and there is no known method of shape control which takes into account the relationship between the individual stands of a series of rolling stands constituting a tandem mill.

It is common knowledge that in a so-called tandem mill comprising a series of rolling stands, there exists interstand tension which acts on the material to be rolled. Therefore, if any of the known methods of shape corrrection are applied as such to a tandem mill, variations in the interstand tension between the stand selected for control and the preceding stand, as well as the interstand tension between this selected stand and the succeeding stand, result in variation in the rolling loads of the three stands, with resultant variations in the thickness and shape of the rolled product. In other words, this application of the known methods would give rise to unnecessary changes in the shape that would be added to the desired shape corrections effected at the delivery side of the respective stands, and thus the desired shape correcting effect would not be obtained. Secondly, if the selected stand is not the final stand, the shape correcting effect obtained at the selected stand will be successively reduced during the rolling at the succeeding stands. Thus, the desire shape control effect cannot be achieved at the delivery side of the final stand. Thirdly, and lastly, the change in the strip thickness due to the shape correcting action will bring into operation the automatic gauge control (AGC) system, which further changes the shape of the strip. Thus, there is the danger of not only interfering with the desired shape correcting action, but also causing the entire control system to hunt. For these reasons, it is apparent that the primary object of shape control cannot be achieved.

In other words, since the aforesaid known methods of shape control are designed for use on a single stand, these known methods are wholly inapplicable to tandem mills. There thus exists the need for a method of shape control for tandem mills, which takes into consideration the mutual effects of the stands and the relationship with other control systems such as the gauge control and the like.

OBJECT OF THE INVENTION

There are the following disturbances that may cause variations in the shape of the strip at the delivery side of the last stand in a tandem mill:

a. A change in the sectional profile of the material to be rolled due to a change in the incoming workpiece, such as a block, coil or the like.

b. A change in the roll opening setting for each stand due to roll bending.

c. A change in the rolling load for each stand due to a change in the steel grade or thickness of the material in the course of the rolling operation.

d. A change in the forward and backward tensions for each stand.

e. A change in the roll crown at each stand, such as, an increased heat crown due to thermal expansion of the rolls or a decrease in the crown, due to wear of the rolls.

It is therefore an object of the present invention to provide an improved method of shape control whereby in the rolling of strip in a tandem mill, variations in the shape of the strip due to the occurrence of any of the abovementioned disturbances are detected at the delivery side of the last stand and thus the predetermined roll bending force for the selected stands are altered effectively to perform the shape control with respect to the long-edge shape of the strip, and thereby to minimize the length of substandard shape strip.

It is another object of the present invention to provide an improved method of shape control which can be used in association with an automatic gauge control system without any inconvenience and which takes into consideration the effects of variations in shape arising at the respective stands on the succeeding stands, whereby to achieve maximum efficiency and thereby to obtain a product strip having a shape and thickness of greater accuracy.

BRIEF SUMMARY OF THE INVENTION

According to the invention there is provided a method of shape control for a hot-rolling or cold-rolling tandem mill wherein, during the rolling of strip by said tandem mill, the long-edge shape of strip at the delivery side of the final stand in said tandem mill is detected to produce a signal corresponding to said detected shape, and the roll bending force for at least two of the last stands in said tandem mill are adjusted in accordance with said detected signal to control the shape of the strip without producing variations in the thickness of strip at said delivery side of said final stand.

EXPLANATION OF THE INVENTION

The basic concept of this invention stems from the conclusion that the sub-standard shape of the strip results from a buckling phenomenon in the strip due to differences in longitudinal elongation at various points across the width of the strip. The strip was longitudinally divided through a given number of points across the transverse direction of the strip and the sub-standard shape of the strip was quantitatively considered in terms of the differences between the elongations at the respective dividing points and the average value of the elongations at these points.

In other words, a sub-standard shape, for example at the long-edge is due to the non-uniformity in the longitudinal elongations at different points in the direction of the width of strip, and to non-uniformity in the longitudinal tensions at these points which results in an elastic or plastic buckling of the strip. Taking the case for example of a long-middle variation in shape in single-stand rolling as an illustrative example, if a material having a uniform thickness in the direction of the width before the rolling operation shows, after rolling, an increase in longitudinal elongation of the rolled center of the strip in the direction of the width thereof, the distribution of the longitudinal tensions becomes non-uniform in accordance with the distribution of the longitudinal elongations at the different points in the direction of the width of the strip. As a result, the buckling of the rolled strip occurs in the center thereof and this results in a so-called long-middle variation in shape.

In defining the shape of strip in relation to non-uniformity in the longitudinal elongations at different points in the direction of the width of the strip, if $l_{i,k}$ represents the length at the $k$th dividing point in the direction of the width of the strip at the delivery side of the first stand, then the average value of length is given as $$\frac{1}{m}\sum_{K=1}^{m} l_{i,k}$$

(where $m$ is the number of divisions) and consequently the shape at the $k$th dividing point in the direction of width of the strip at the delivery side of the ith stand is expressed as follows:

$$S_{i,k} = \frac{\frac{1}{m}\sum_{k=1}^{m} l_{i,k} - l_{i,k}}{\frac{1}{m}\sum_{k=1}^{m} l_{i,k}} = 1 - \frac{l_{i,k}}{\frac{1}{m}\sum_{k=1}^{m} l_{i,k}} \qquad (1)$$

In the steady state rolling operation of a tandem mill, it is generally known that the distribution of the strip thickness and the strip speed at the delivery side of the respective stands are determined in accordance with the law of constant mass flow. Since the product of the thickness and the rolling speed of the rolled strip at the delivery side of each stand is constant (mass flow constant) and since the movement of the material in the direction of its width is caused by the rolling, the product of the thickness and the length in the rolling direction of the material at each of the transversely minutely divided points of the material is the same both at the entry side and the delivery side of the stand. Consequently, if $l_{o,k}$ represents the length of strip at the $k$th dividing point at the entry side of the first stand and $h_{o,k}$ represents the strip thickness at that point, and if $h_{i,k}$ represents the strip thickness at the kth dividing point at the delivery side of the $i$th stand, then, with $k = 1 \sim m$, the following relationships hold:

$$h_{o,k} \cdot l_{o,k} = h_{i,k} \cdot l_{i,k};$$

$$l_{i,k} = \frac{h_{o,k}}{h_{i,k}} \cdot l_{o,k}$$

This assumes $l_{o,k}$ is constant with $k = 1 \sim m$; that is, there is a presupposition that the length of the incoming strip at each of the different points in the direction of the width thereof is fixed.

Substituting the above equation for $l_{i,k}$ into equation (1), we obtain:

$$S_{i,k} = 1 - \frac{\frac{h_{o,k}}{h_{i,k}} \cdot l_{o,k}}{\frac{1}{m}\sum_{k=1}^{m} \frac{h_{o,k}}{h_{i,k}} \cdot l_{o,k}}$$

$$= 1 - \frac{\frac{h_{o,k}}{h_{i,k}}}{\frac{1}{m}\sum_{k=1}^{m} \frac{i_{o,k}}{h_{i,k}}}$$

$$= 1 - \frac{\frac{h_{o,k}}{h_{i,k}}}{\frac{h_{o,m}}{h_{i,m}}} \qquad (2)$$

Here $h_{o,m}$ and $h_{i,m}$ represent respectively the average strip thickness at the entry side of the first stand and at the delivery side of the $i$th stand.

Now considering the deviations of shape due to the previously mentioned disturbances, total differentiation of equation (2) results as follows:

$$\Delta S_{i,k} = 31\ \frac{h_{i,m}}{h_{o,m}} \quad \frac{\Delta h_{o,k}}{h_{i,k}} - \frac{h_{o,k}}{h_{i,k}} . \Delta h_{i,k}$$

$$= -\frac{1}{h_{o,m}} \cdot \frac{\Delta h_{o,k}}{\frac{h_{i,k}}{h_{i,m}}} + \frac{h_{o,k}}{h_{o,m}} \cdot \frac{\Delta h_{i,k}}{\left(\frac{h_{i,k}}{h_{i,m}}\right)^2} \cdot \frac{1}{h_{i,m}}$$

In this case, if the sub-standard shape is considered to exist when $h_{i,k}$ or $h_{o,k}$ deviates by 0,2 percent from the respective average value $h_{i,m}$ or $h_{o,m}$, then $h_{i,k}/h_{i,m}$ and $h_{o,k}/h_{o,m}$ respectively approximate unity. Therefore, $\Delta S_{i,k}$ is given as:

$$\Delta S_{i,k} \approx -\frac{\Delta h_{o,k}}{h_{o,m}} + \frac{\Delta h_{i,k}}{h_{i,m}}$$

$$= -\frac{\Delta h_{o,k}}{h_{o,m}} + \frac{\Delta h_{1,k}}{h_{1,m}} + -\frac{\Delta h_{1,k}}{h_{1,m}} + \frac{\Delta h_{2,k}}{h_{2,m}} \cdots$$

$$\cdots -\frac{\Delta h_{i-2,k}}{h_{i-2,m}} + \frac{\Delta h_{i-1,k}}{h_{i-1,m}} + -\frac{\Delta h_{i-1,k}}{h_{i-1,m}} + \frac{\Delta h_{1,k}}{h_{i,m}}$$

$$\Delta S_{i,k} = \Delta S_{i-1,k} + -\frac{\Delta_{i,k}}{h_{i-1,m}} + \frac{\Delta h_{i,k}}{h_{i,m}}$$

-continued $$= \Delta S_{i-1,k} + - \Delta S_{i-1,k} + \Delta S_{i,k} \quad (2')$$

Where $$\Delta S_{i,k} = \frac{\Delta h_{i,k}}{h_{i,m}}$$

Here, the above term $\Delta s_{i,k}$ is divided into $\Delta s_{i,}A_k$ representing the variations of shape at the delivery side of the stand in respect of the effect of the disturbances at said stand, and $\Delta s_{i,}B_k$ representing the variations of shape at the delivery side of the stand in respect of the change in the sectional profile of the incoming strip at the entry side of that stand, and thus we obtain:

$$\Delta s_{i,k} = \Delta s_{i,}A_k + \Delta s_{i,}B_k \quad 3$$

The above term $\Delta s_{i,}B_k$ is a value that is possible only in a tandem mill and thus if $W_{i,k}$ represents the coefficient of influence on shape, then we obtain:

$$\Delta s_{i,}B_k = W_{i,k} \cdot \Delta s_{i-i,k} \quad 4$$

This shape influence coefficient $W_{i,k}$ is one that is dependent on the dimensions of the mill, the schedule of roll passes and so on, and it is obtained for each stand of a mill through a calculation made by taking into consideration the elastic deformation of the stand and the rolls. For example, it is determined, as shown in FIG. 2 of the latter described drawings, with the following dimensions of the mill and schedule of rolling passes:

| | |
|---|---|
| Rolling mill: | five-stand cold-rolling tandem mill |
| Work roll diameter: | 610 mm $\phi$ |
| Backup roll diameter: | 1,455 mm $\phi$ |
| Roll barrel length: | 1,370 mm |
| Distance between roll choke centres: | 2,330 mm |
| Roll neck diameter: | 827 mm $\phi$ |
| Rolling schedules: | |

| Stand | Strip thickness at entry side of stand (mm) | Backward tension (kg/mm²) |
|---|---|---|
| No. 1 | 3.80 | 3.0 |
| No. 2 | 3.06 | 16.0 |
| No. 3 | 2.30 | 16.0 |
| No. 4 | 1.72 | 16.0 |
| No. 5 | 1.29 | 16.0 |
| Delivery side of No. 5 stand | 1.20 | 3.0 |

| | |
|---|---|
| Strip width: | 959 mm |
| Number of divisions: | k = 28 |

Therefore, utilizing the above-mentioned influence coefficient $W_{i,k}$; $\Delta s_{i,k}$ is given from the above equation (2)', (3) and (4) as follows:

$$\Delta s_{i,k} = \Delta s_{i-i,k} + \Delta S_i A_k + (W_{i,k} - 1)\Delta s_{i-i,k} \quad 5$$

Thus, from the above equation (5), the variations of the shape out of the *i*th stand due to the disturbances can be obtained in terms of the sum of: (*a*) the deviations of shape out of the preceding stands, (*b*) the variations of shape out of the delivery side of the stand in respect of the effect of the disturbances on the stand consideration, and (*c*) the variations of shape out of the delivery sides of the preceding stands plus the degree of influence dependent on the dimensions of the stand under consideration, etc. In this way, the variations out of the preceding stands are taken into account.

BRIEF DESCRIPTION OF DRAWINGS

FIGS. 1(*a*) and 1(*b*) show representative types of bad strip shape, FIG. 1 (*a*) indicating long-edge shape and FIG. 1 (*b*) long-middle shape;

FIG. 2 is a graph showing by way of example the influence coefficient for a five-stand cold rolling tandem mill;

The applicants have conducted detailed investigations into the factors which produce variations in the shape of material rolled in a tandem mill by applying the previously mentioned equation (5) to the case of a five-stand cold rolling tandem mill. These investigations were carried out in the following manner. In addition to simulating the factors which produce variations in material thickness in a tandem mill, the previously mentioned relationships showing the variations in shape and the mechanism of an AGC system were utilized to study the variations of long-edge shape and long-middle shape which took place when the material thickness changed in steps in a five-stand cold rolling tandem mill. The results obtained are shown in FIGS. 3 and 4. In FIG. 3 showing the patterns of variations in shape out of the individual stands due to the changes in material thickness, the abscissa represents the time (second) and the ordinate represents the deviation of shape function ($\Delta S_{i,k}$) corresponding to the long-edge shape, while FIG. 4 shows similarly the deviation of shape function ($\Delta S_{i,k}$) corresponding to the long-middle shape. As will be seen from FIGS. 3 and 4, where no shape control was effected, while the variations in shape caused by the disturbances at the entry side of the first stand were lessened in the succeeding stands, a certain degree of deviation of shape still continued to occur.

This is substantiated by the fact that, as will be seen from FIG. 2, the influence coefficient $W_{i,k}$ of each stand is greater than that of the preceding stand, and thus the last stand has the largest influence coefficient. Therefore, the shape control in tandem mills can be most effectively performed if the control is effected at the last stand. However, the AGC system is usually installed on the last stand in a tandem mill and therefore any change in the rolling load due to the shape control tends to cause the control system to hunt. In accordance with the present invention, therefore, in the case of long-edge shape control where the roll bending force is altered by the roll bender, the last stand is included in those subjected to the shape control since the range of variations of shape due to the benders is narrow. Thus taking into account these circumstances and the values of the above-mentioned influence coefficient $W_{i,k}$, the control is effected, in general, on at least two latter stands where high control efficiency can be expected.

DESCRIPTION OF THE PREFERRED EMBODIMENTS

The shape control method according to the present invention will now be described with reference to the illustrated embodiments. The sub-standard shape such as the deviations in the long-edge shape or long-middle shape, are detected as the difference between the longitudinal elongations at the previously mentioned different dividing points across the width of strip and the average value thereof obtained at the delivery side of the final stand, as shown by the previously mentioned equations. The roll bending force or rolling load for the preselected stands is altered in accordance with the detected signal to effect the necessary shape control. The shape detector is one which is provided with a suitable number of sensing points arranged in the direction of the width of the strip, including sensing points at the edges of the strip for the long-edge shape and sensing points in the vicinity of the long-middle portion of the strip for the long-middle shape. In practice, a detector of the non-contact type, which detects the difference in the distribution of tension as variations of permeability, an air micrometer, or a detector of the type which measures the diffusion of light and detects the variations of shape in accordance with the irregularities in the strip surface, is preferred.

Figure 3:
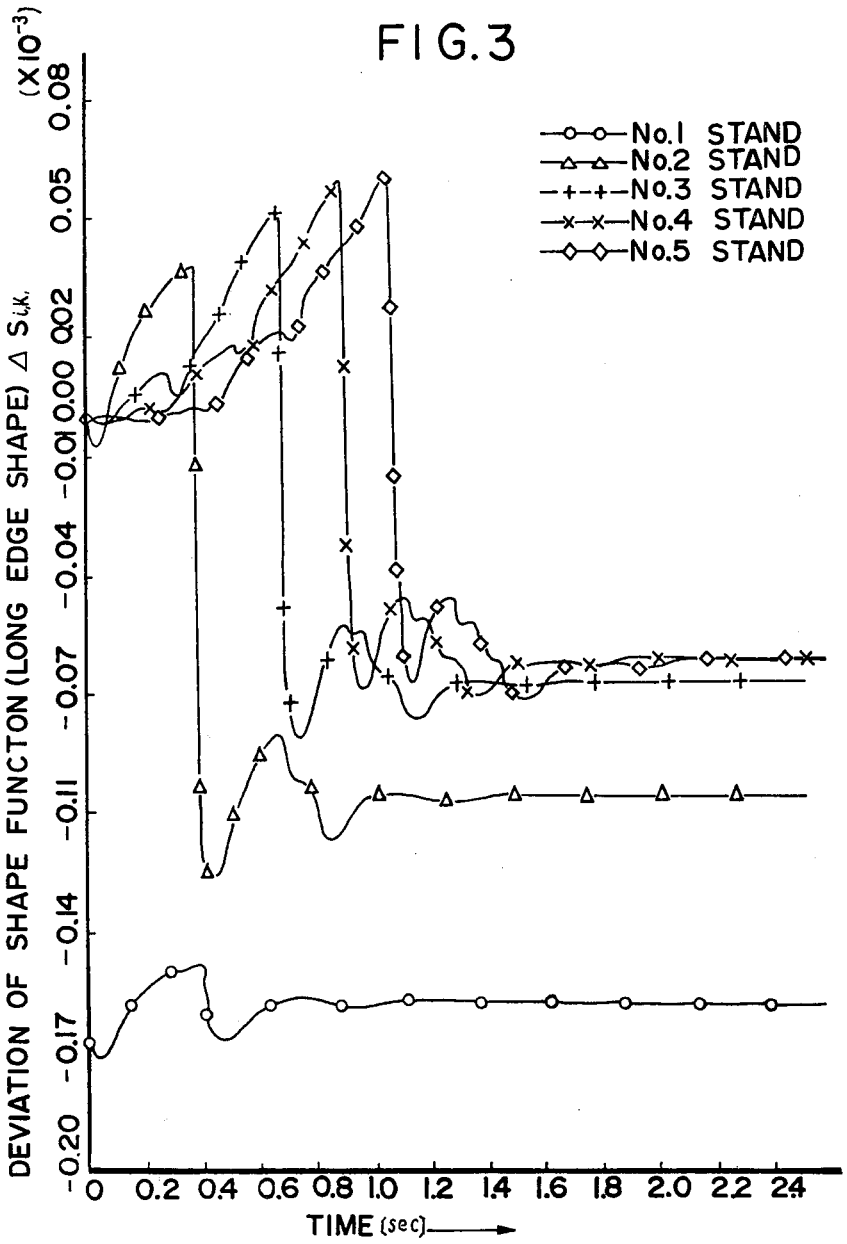
FIG. 3 is a graph showing the variations of the long-edge shape out of the individual stands in the five-stand cold rolling tandem mill, caused by the stepped variations of strip thickness in the course of the rolling operation.
Figure 4:
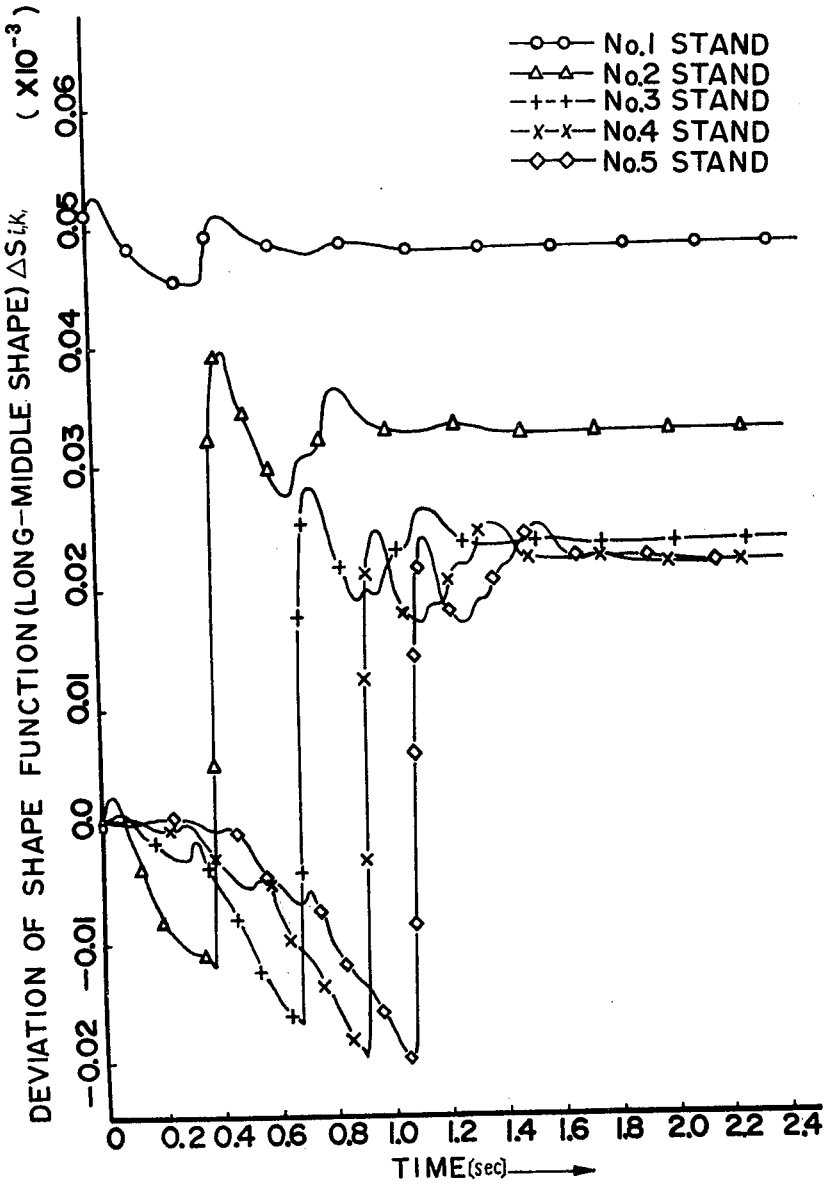
FIG. 4 is a graph showing the variations of the long-middle shape in an example similar to FIG. 2.
Figure 5:
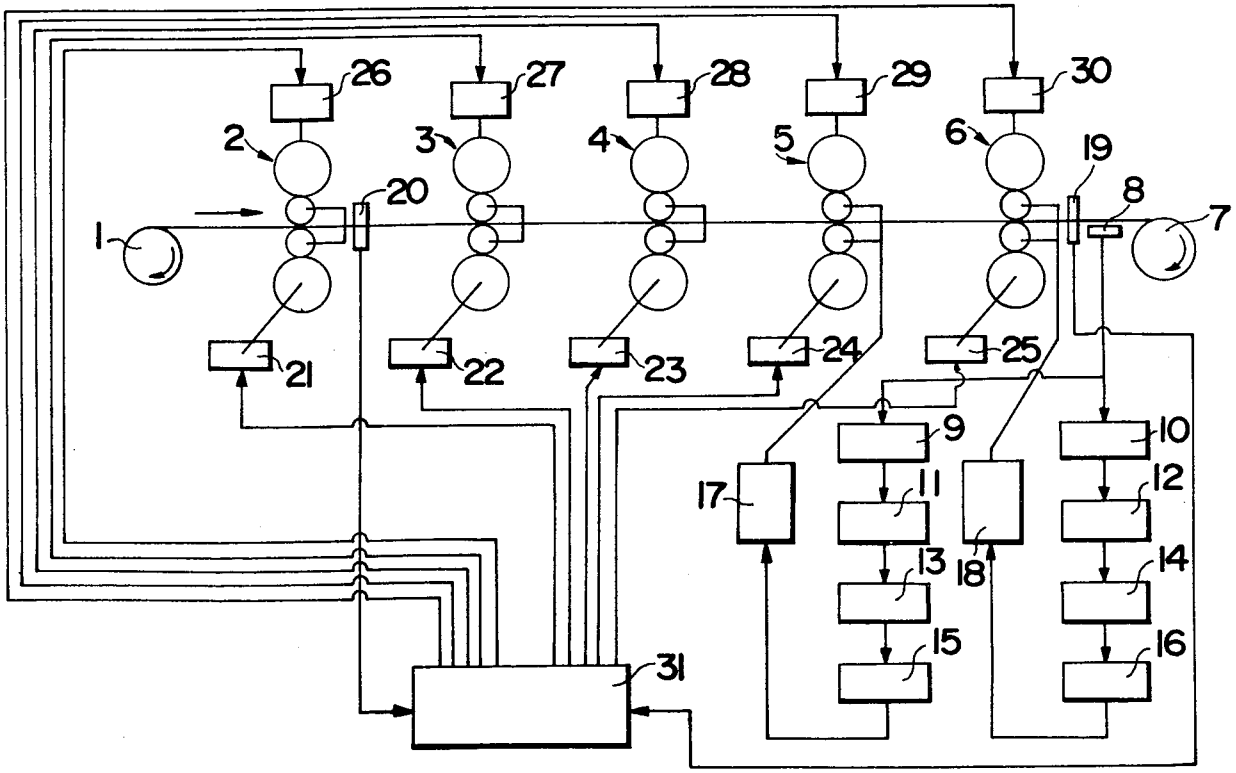
FIG. 5 is a block diagram of a control system according to one embodiment of the present invention, which effects the necessary shape corrections with respect to the long-edge shape and/or long-middle shape by altering the roll bending force.

FIG. 5 is a block diagram of a control system designed to effect shape control for the long-edge shape or the long-middle shape, at the fourth and fifth stands, by altering their roll bending force. In FIG. 5, numeral 1 designates an uncoiler. Numerals 2, 3, 4, 5 and 6 designate first, second, third, fourth and fifth stands, respectively, 7 a tension reel and 8 a shape detector of the above-mentioned type. The output of the shape detector 8 corresponds to the long-edge shape or long-middle shape as mentioned previously, and this is continuously detected from the strip delivered from the fifth or final stand 6. The detected signals are fed to each of differential bender output deviation generators 9 and 10 so that signals greater than the dead zone of the differential deviation generators 9 and 10 are fed out as differential deviations representing the variations from the desired shape and are respectively converted in integrators 11 and 12 into a signal representing the sum of the variations. The output signal of the integrators 11 and 12 is respectively applied to bender output signal control units 13 and 14.

Each of the bender output signal control units 13 and 14 comprises a proportioning circuit having a predetermined gain, an integrator and a differentiator. The output signals of the control units 13 and 14 are respectively supplied as bender outputs, by way of limiters 15 and 16, to bender actuation controllers 17 and 18 for the fourth and fifth stands. Consequently, the bender actuation controllers 17 and 18 respectively operate the roll benders of the fourth and fifth stands 5 and 6 to increase or decrease the roll bending force in accordance with the sign and magnitude of the deviations of the elongations detected by the shape detector 8. In this case, the invention is conveniently applied to a known rolling process control system in which roll speed controllers 21, 22, 23, 24 and 25 and rolling load controllers 26, 27, 28, 29 and 30 for the respective stands are respectively controlled in accordance with a predetermined program by an on-line computer 31 in response to measurement inputs applied from X-ray gauges 19 and 20 which are respectively arranged at the delivery sides of the fifth and first stands to effect the gauge control. This method is utilized simultaneously to perform the relling operation so that the thickness at the delivery side of the fifth stand is maintained constant at the set point, in addition to providing the shape control.

Figure 6:
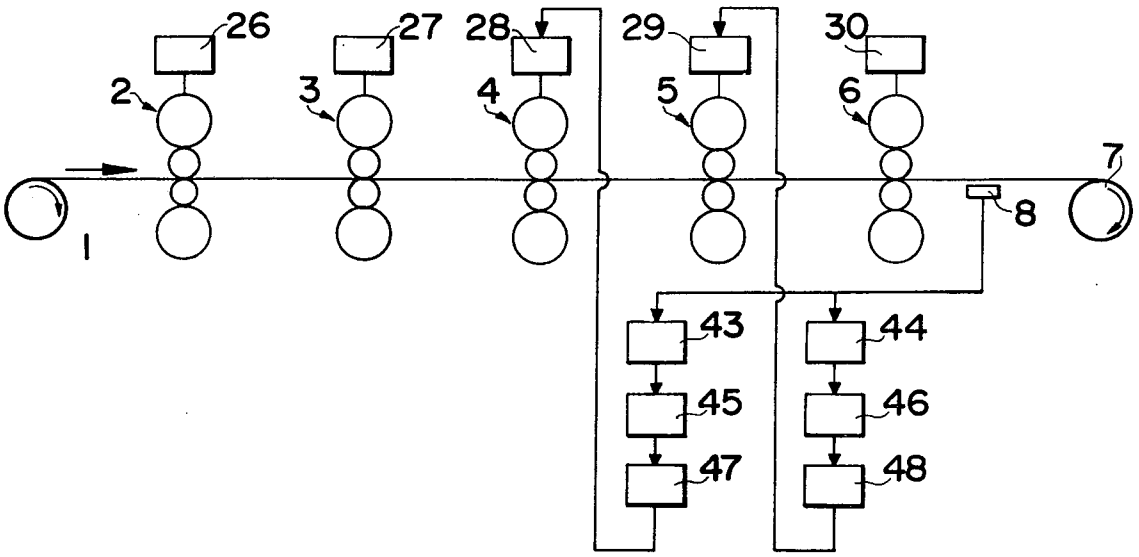
FIG. 6 is a block diagram of a control system according to another embodiment of the present invention, which effects the necessary shape corrections with respect to the long-middle shape by changing the rolling load pattern.

FIG. 6 is a block diagram of a control system according to another embodiment of this invention in which the shape control is effected on the third and fourth stands to control the long-middle shape. In FIG. 6, those component parts designated by identical reference numerals as used in FIG. 5 indicate the corresponding parts. In this control system, the output of the shape detector 8 is a signal corresponding to the long-middle shape of strip and the detected signals of the shape detector 8 are applied to differential set roll opening deviation generators 43 and 44 for the third and fourth stands 4 and 5, respectively, so that signals greater than the dead zone of the differential deviation generators 43 and 44 are fed out as differential deviations representing the variations from the desired shape and are respectively converted in integrators 45 and 46 into a signal representing the sum of the variations. The output signal of the integrators 45 and 46 is applied to set roll opening output signal control units 47 and 48.

The set roll opening output signal control units 47 and 48 respectively operate rolling load control elements 28 and 29 for the third and fourth stands 4 and 5 in response to the sign and magnitude of the input signals in accordance with the preliminarily predicted changes in the rolling conditions, so that the respective rolling load patterns of the third and fourth stands 4 and 5 are altered to maintain constant the thickness at the delivery side of the final stand. In fact, as described earlier, the effect of the shape control at each of the individual stands is greater than the preceding one, and therefore the rolling load control element 29 for the fourth stand 5 plays the principal role in altering the rolling load for shape correction and the rolling load control element 28 for the third stand 4 alters the rolling load to compensate for the required alteration of rolling load for shape correction, whereby to maintain constant the thickness of the strip at the delivery side of the final stand. Since the control system of FIG. 6 alters the rolling load to effect shape control, the final stand is excluded from the application of the control, so that the interaction between this control system and the AGC system on the final stand does not give rise to hunting of the entire control system.

In the control system of FIG. 6, the shape control is effected on two of the last stands, i.e., the third and fourth stands, as described earlier, and at the same time provision is made to maintain the strip thickness at the delivery side of the final stand constant. However, if the previously mentioned on-line computer 31 is employed to maintain the strip thickness at the delivery side of the final stand constant, as shown in FIG. 7, the control system of FIG. 6 may be applied to the fourth stand only to achieve effective shape control.

Figure 7:
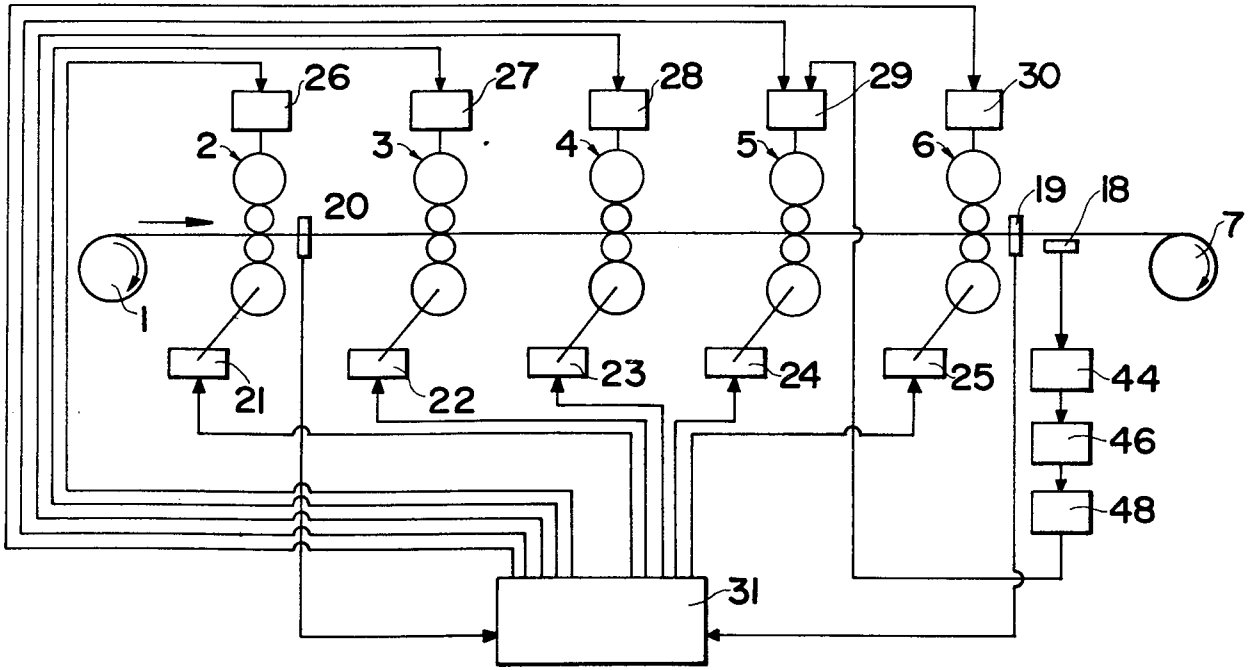
FIG. 7 is a block diagram of a similar control system according to still another embodiment of the present invention.

The above-described control systems, particularly the control systems according to the embodiments shown in FIGS. 5, 6 and 7 and adapted for the control of long-middle shape, are designed to be selected in accordance with the predicted magnitude of the output signal of the shape detector 8. Thus, the control methods of FIGS. 5, 6 and 7 may be selected in this manner in order of the magnitude of the output signal of the shape detector 8. Indeed, the control circuitry is preferably constructed so that these control methods may be selected to deal with different coils in the rolling pass schedules.

Further, while in the embodiments so far described, the shape control is effected individually with respect to either the long-edge shape or the long-middle shape, if both of them are to be subjected to shape control simultaneously, it is possible to use the control method of FIG. 5 for controlling the long-edge shape and the control method of FIGS. 6 or 7 for controlling the long-middle shape, the control circuitry being arranged in such a manner that these control methods are combined and applied simultaneously.

Figure 8:
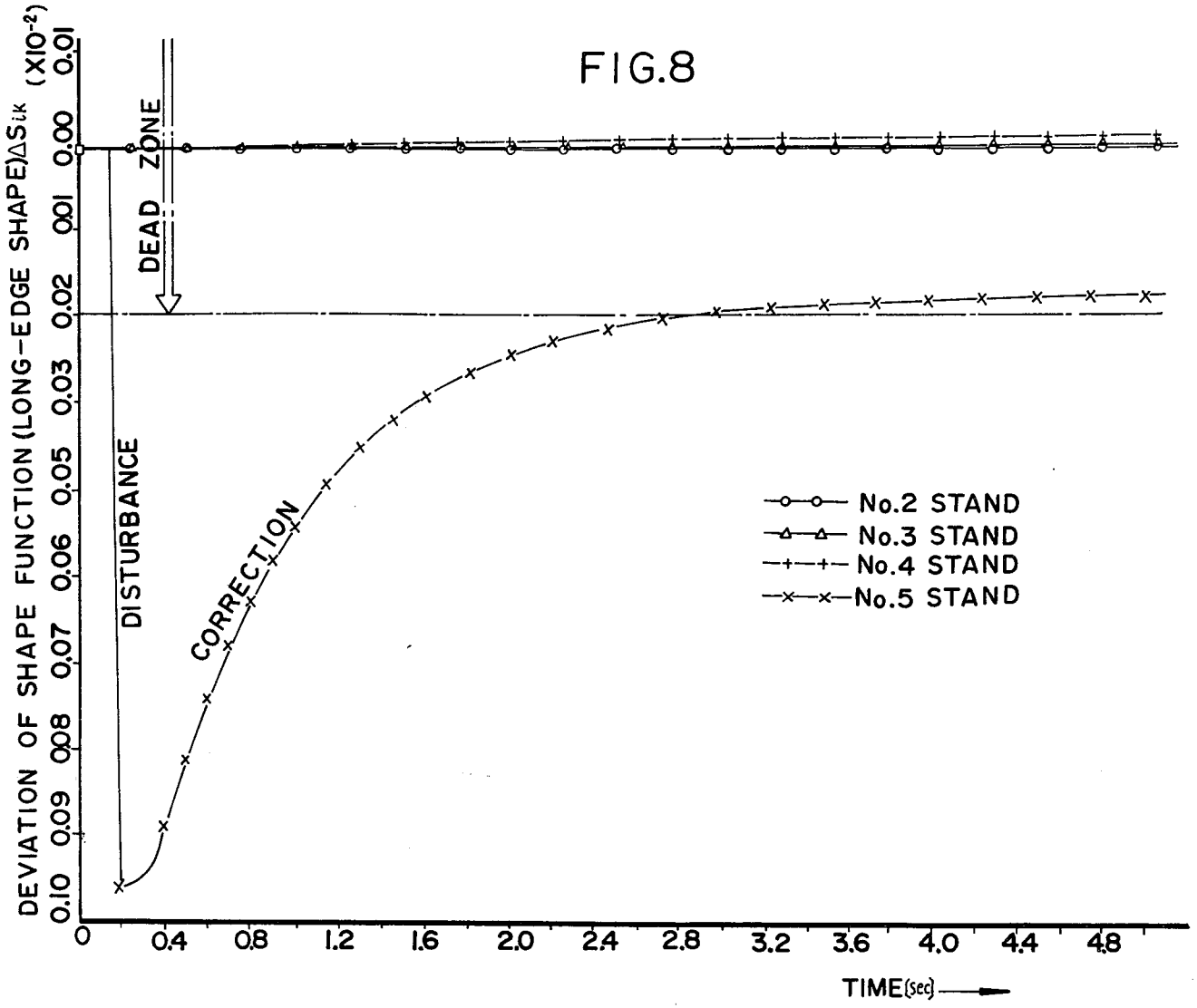
FIG. 8 is a graph showing one form of the long-edge shape correction action in accordance with the shape control method of the present invention.

FIG. 8 shows the results obtained when the shape control method (FIG. 5) of this invention was applied to a five-stand cold rolling mill.

Figure 9:
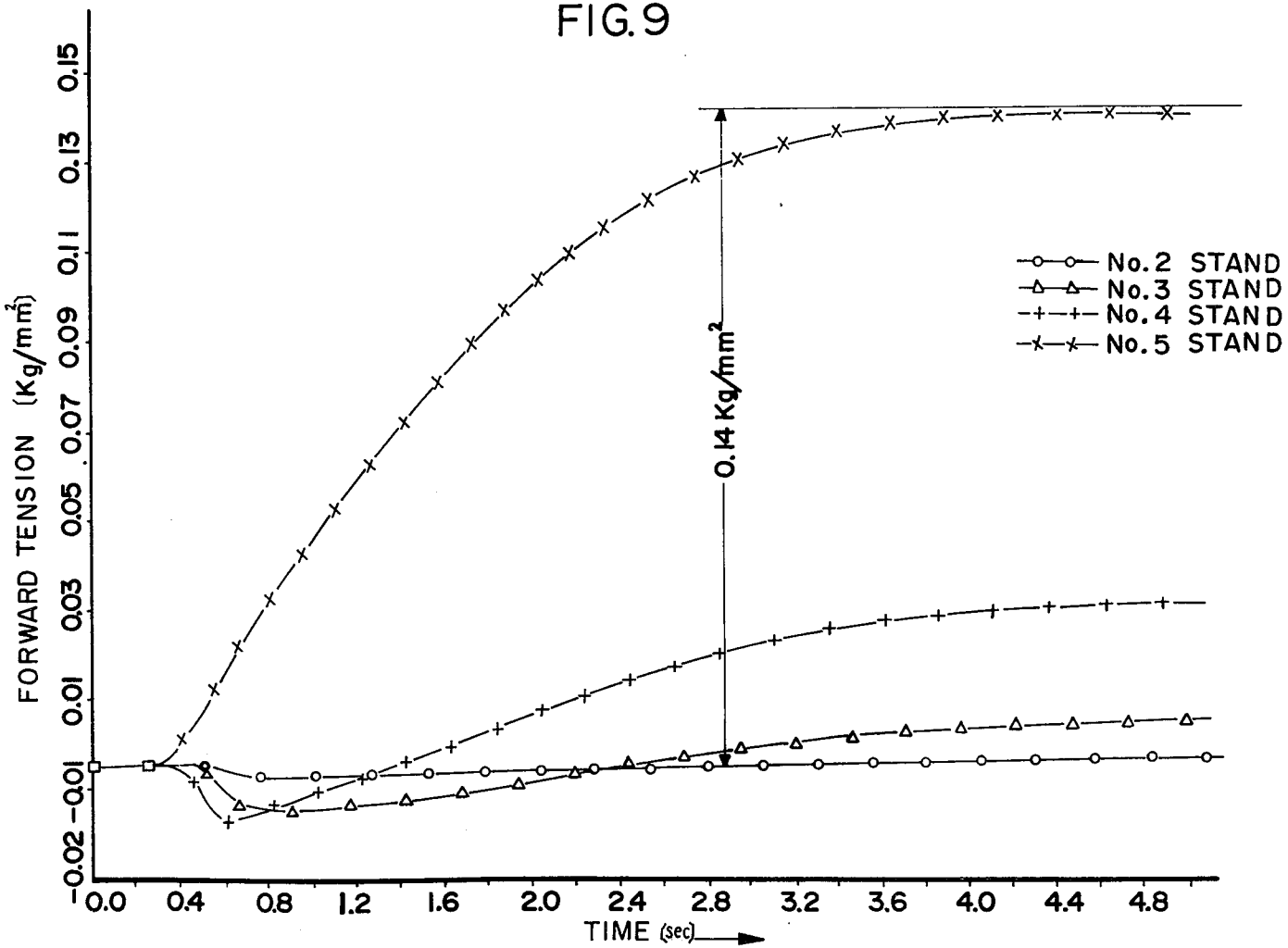
FIG. 9 is a graph showing the variations of the forward tension for the individual stands during the long-edge shape correction action of FIG. 7.

In this case, though the ordinary AGC system was provided on each of the first and fifth stands, the deviations in long-edge shape caused by the previously mentioned disturbances imposed on the last stand were reduced considerably by the correcting action according to this invention. Thus, there was no deterioration of the control effect and no inconvenience such as hunting, which is usually encountered with conventional methods in which shape control is applied to one stand only. Further, as will be seen from FIG. 9, the range of variations of the interstand tension was narrow, i.e., it was, at the most, as low as about 1 percent of the ordinary tension.

While, in the embodiments described hereinbefore, the present invention has been applied to a cold rolling tandem mill, the shape control method of this invention is not limited thereto. For example, the present invention is applicable to all cold temper rolling mills wherein the rolling is effected through more than two stands by means of tension. Of course, the present invention may also be applied to hot rolling tandem mills. In the case of a hot rolling tandem mill, the uncoiler 1 is eliminated and a looper is provided between successive stands. The effects on the tension by such loopers are negligibly small and their effects on the tension can thus be ignored. However, other factors of a preceding stand affect the succeeding stands and in this sense there is the same phenomenon as in the case of cold rolling tandem mills. As a result the shape control method according to the present invention can be effectively applied to the hot rolling tandem mills without any disadvantages.

It will thus be seen from the foregoing description that with the shape control method according to the present invention, shape control can be effected to control the long-edge shape or long-middle shape individually or to control both of them simultaneously. Thus, contrary to the cases where the conventional single-stand shape control method is applied as such, the effects of variations in shape out of the individual stands are jointly taken into consideration and therefore it is possible to effect any required shape correction with minimum time. The control system of this invention can be used in combination with other control systems such as a gauge control system (e.g. an AGC system) without difficulty. The present invention can achieve remarkable shape modifying effects in addition to the control effects explained. The benefits of this invention, such as, the improved yield of product as well as the benefits in terms of the improved quality control, and the improved operational management, are therefore very substantial.

We claim:

1. A method of product-shape control carried out during rolling of a strip by a tandem rolling mill having a plurality of tandem-arranged adjacent rolling stands, comprising:

determining a shape influence coefficient which is a function of at least the dimensions of the tandem mill, schedule of roll passes and elastic deformation of the stands and rolls;

detecting, during rolling, the long-edge shape of the strip at the delivery side of the final stand in stand tandem mill;

producing a signal corresponding to said detected long-edge shape; and adjusting the roll bending force for at least two latter stands, but not all stands, in said tandem mill as a function of said signal and as a function of said shape influence coefficient to control the shape of the strip without producing variations in the thickness of the strip at said delivery side of said final stand, and without producing variations in the inter-stand tension between each pair of adjacent stands.

2. A method of product-shape control according to claim 1 wherein the last stand of said tandem mill is included in the roll bending adjustment in accordance with said signal.

3. A method of product-shape control according to claim 1 comprising adjusting the roll bending force for the last two stands of said tandem mill.

4. A method of product-shape control according to claim 1 wherein said adjusting step comprises integrating said signal corresponding to said detected long-edge shape to produce a further signal representing the sum of the variations in the long-edge shape, and controlling the roll bending force for at least two latter stands as a function of at least said integrated signal.

5. A method of product-shape control according to claim 4 wherein said integrating step comprises generating two integration signals which are respective functions of said signal corresponding to said detected long-edge shape, and adjusting the roll bending force for respective stands as a function of at least a respective one of said integration signals.

6. A method of product-shape control according to claim 4 comprising passing said signal corresponding to said detected long-edge shape through a differential deviation generator to produce signals representing variations exceeding a predetermined deviation from a desired strip shape.

7. A method of product-shape control according to claim 1 wherein said step of adjusting the roll bending force for at least two latter stands comprises adjusting said roll bending force as a function of said produced signal, the deviations of shape of the strip out of the preceding stands in said tandem mill and the variations of shape out of the delivery sides of the preceding stands of said mill modified by said shape influence coefficient.

8. A method of product-shape control according to claim 1 wherein said adjusting step comprises generating a further signal which is a function of said shape influence coefficient, and adding said further signal with said produced signal to develop a control signal to control the shape of said strip without producing said variations in thickness of the strip and without producing said variations in the inter-stand tension.

* * * * *

UNITED STATES PATENT AND TRADEMARK OFFICE

CERTIFICATE OF CORRECTION

PATENT NO. : 3,934,438

DATED : January 27, 1976

INVENTOR(S) : Tohru ARIMURA et al

It is certified that error appears in the above-identified patent and that said Letters Patent are hereby corrected as shown below:

Column 10, line 28, after "final stand in" change "stand" to --said--.

Signed and Sealed this

*eighth* Day of *June 1976*

[SEAL]

*Attest:*

RUTH C. MASON
*Attesting Officer*

C. MARSHALL DANN
*Commissioner of Patents and Trademarks*